United States Patent [19]

Donaldson et al.

[11] Patent Number: 4,620,135

[45] Date of Patent: Oct. 28, 1986

[54] ELECTRIC CIRCUIT INTERRUPTING DEVICES

[75] Inventors: Timothy P. Donaldson, Great Totham; Raymond P. Knight, Braintree; John R. Shepheard, Great Baddow, all of England

[73] Assignee: English Electric Valve Company Limited, Chelmsford, England

[21] Appl. No.: 545,272

[22] Filed: Oct. 25, 1983

[30] Foreign Application Priority Data

Oct. 27, 1982 [GB] United Kingdom ..... 8230695

[51] Int. Cl.[4] ..... H01J 17/44

[52] U.S. Cl. ..... 315/326; 315/339; 315/335; 313/589; 313/597; 313/609; 313/595; 313/268; 313/293

[58] Field of Search ..... 315/326, 339, 335; 313/589, 597, 600, 609, 296, 325, 268, 293, 595, 598

[56] References Cited

U.S. PATENT DOCUMENTS 4,155,026 5/1979 Nixon ..... 313/268 X

FOREIGN PATENT DOCUMENTS 860867 2/1961 United Kingdom ..... 313/598

1118565 7/1968 United Kingdom .

OTHER PUBLICATIONS

E. O. Johnson et al., "The Tacitron, A Low Noise Thyratron Capable of Current Interruption by Grid Action", *Proceedings of the I-R-E*, Sep. 1954, pp. 1350–1362.

*Primary Examiner*—David K. Moore
*Assistant Examiner*—Vincent DeLuca
*Attorney, Agent, or Firm*—Spencer & Frank

[57] ABSTRACT

A thyratron utilizable as a circuit interrupting protective device is provided. The thyratron includes an apertured grid between anode and cathode which is divided transversely into two parts separated by an insulating layer. Both surfaces of the composite grid remote from the insulating layer carry conductive meshes which meshes cover the exits of the apertures in the composite grid. The thickness of the insulating layer and the dimensions of the meshes are such that no point within an aperture is further from a part of the grid or a mesh than the Debye distance whereby the effects of Debye shielding tend to be reduced when a negative potential is applied between two said parts of said grid to quench a discharge previously initiated by applying positive potential to both parts of the grid.

12 Claims, 2 Drawing Figures

ELECTRIC CIRCUIT INTERRUPTING DEVICES

BACKGROUND OF THE INVENTION

This invention relates to electric circuit interrupting devices, and more specifically to circuit interrupting gas discharge tubes, and circuit arrangements incorporating the same.

One example of gas discharge tube which may be used as a circuit interrupting gas discharge device is a thyratron, that is to say an electronic tube having within an envelope containing a gas or vapour filling, an anode and a cathode and at least one control grid between said anode and cathode.

It is desirable, particularly when said thyratron is utilised as a circuit protection device, for quenching to be effected rapidly.

It is known, from our prior United Kingdom specification No. 1,494,051, for example, to arrange form means for producing a magnetic field in the region of the discharge, and extending transversely thereto, to effect quenching. Such a technique is inconvenient however.

One technique which might be thought to be simple and attractive in order to effect quenching by an electrostatic effect, is to apply a negative potential to a control grid to which previously a positive potential had been applied in order to initiate discharge. However, it has been found that such a technique with thyratron tubes as at present known is unsatisfactory.

SUMMARY OF THE INVENTION

One object of the present invention is to provide an improved thyratron in which quenching may be effected relatively rapidly and reliably by an electrostatic effect.

According to this invention a thyratron includes at least one apertured control grid between anode and cathode which apertured control grid is divided transversely into two electrically isolated parts which have a spacing one from the other in the region of an aperture through said two parts which is less than the Debye length in that region.

In a circuit arrangement incorporating a thyratron as described above, normally means are provided at one time to connect said two parts together and apply positive potential to both in order to initiate discharge and at another time to apply negative potential between said two parts in order to effect quenching.

Whilst the sufficiency of this specification in no way depends upon the following explanation, the effect achieved by the present invention may be explained as follows:

It is assumed that with a conventional thyratron it is desired to use one grid both to initiate and quench discharge. With the conventional thyratron, a sufficiently large voltage pulse applied to the control grid causes the thyratron to "switch on" by ionising the gas contained by the envelope. This ionised gas, consisting of electrons and ions has the advantageous effect of carrying the current. However there is also a deletereous effect, in that it causes the grid to "lose control". This happens when any further voltage pulse is applied to the grid after ionisation, e.g. when a positive voltage pulse is applied to the control grid electrons are attached to it, causing charge separation between the electrons and ions in the ionised gas. This charge separation causes an electric field around the control grid region of equal magnitude but of opposite direction which exactly cancels the applied field. This is known as "Debye shielding". The thickness of this shielding layer is approximately equal to a dimension called the "Debye screening length". At distances from the grid less than this Debye screening length the influence of the applied voltage can be felt. Therefore, if the voltage on the control grid is applied over a gap less than the Debye screening length, the Debye shielding will not be entirely effective. Thus if the voltage is applied to the control grid over a gap less than the Debye screening length, i.e. over the spacing between the two parts of the said apertured control grid of the present invention, the grid will tend to keep control when the gas is ionised.

Preferably said two parts extend parallel to one another at least throughout the region of discharge.

Preferably again said two parts are separated by a layer of insulating material, such as mica or ceramic.

Preferably again, particularly when the transverse dimensions of the aperture or apertures in said grid are such that any point within said aperture is further from one or other of said parts than the aforementioned Debye length, the exits of the aperture or apertures on either side of said grid are covered by electrically conductive gratings, for example conductive wire mesh, electrically connected to the adjacent part of said grid and so dimensioned that no point within said aperture is further from one or other of said parts or a grating than the aforementioned Debye screening length.

Preferably each of said parts has a continuous conductive wire mesh extending over its surface at which said aperture or apertures exit.

BRIEF DESCRIPTION OF THE DRAWINGS

The invention is illustrated in and further described with reference to the accompanying drawing in which.

Like reference numerals are used to denote like parts in FIGS. 1 and 2.

DETAILED DESCRIPTION OF THE PREFERRED EMBODIMENT

Figure 1:
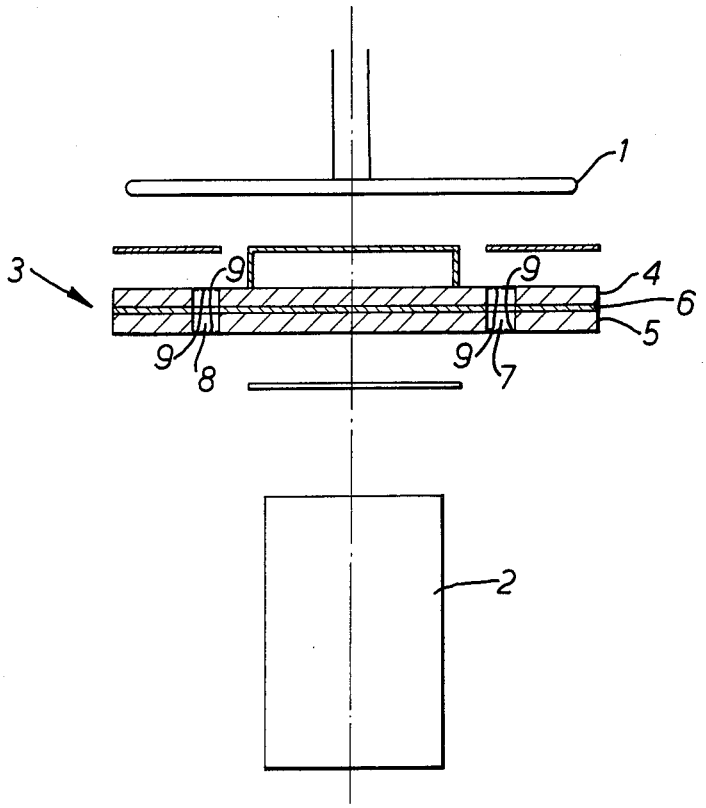
FIG. 1 shows in longitudinal section the elements of one example of a thyratron in accordance with the present invention.

Referring to FIG. 1 within the envelope (itself not shown) of the thyratron is an anode electrode 1, a cathode electrode 2 and, therebetween, a control grid 3.

Control grid 3 is divided transversely to the axis of the thyratron into two parts, an upper conductive layer 4 and a lower conductive layer 5. Layers 4 and 5 are separated by a thin layer 6 of an insulating material. Grid 3 is apertured, there being apertures referenced 7 and 8 passing through both parts 4 and 5 of the grid and through the insulating layer 6 sandwiched there between.

In place extending at right angles to the plane of the paper, both apertures 7, 8 are arcuate in shape, as known per se.

The thickness of the insulating layer 6 is such that the two conductive layers 4, 5 are spaced by a distance which is less than the Debye screening length. In practice the insulating layer 6 is provided to be as thin as possible consistent with maintaining secure electrical isolation between the two conductive layers 4, 5.

The upper surface of the conductive layer 4 and the lower surface of the conductive layer 5 (i.e. the surfaces remote from the insulating layer 6) each carry an electrically conductive mesh 9 which mesh covers the exists of apertures 7, 8. The dimensions of the meshes 9 are chosen such that no point within either aperture 7, 8 is further from a part 4, 5 of the grid 3 or a mesh 9 covering an exit of the aperture than the aforementioned Debye length.

Figure 2:
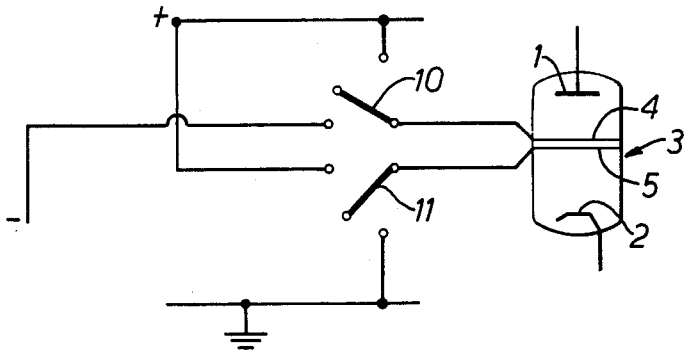
FIG. 2 shows, in highly schematic fashion, the thyratron of FIG. 1 in a circuit arrangement.

Referring to FIG. 2, upper part 4 of the grid 3 is connected to a two-way switch 10 whilst lower part 5 of the grid 3 is connected to another two-way switch 11.

Switch 11 is switchable between two positions in the first of which a pulse of positive potential is connected to conductive layer 5 of grid 3 and in the second of which the conductive layer 5 is connected to earth.

Switch 10 is switchable between two positions in the first of which a pulse of positive potential (the same positive potential as that of the pulse applied to conductive layer 5) is connected to conductive layer 4 of grid 3 and in the second position of which negative potential is connected to the conductive layer 4.

Thus by switching switches 10 and 11 to their first positions, a pulse of positive potential is applied to both conductive layers 4, 5 of the grid 3 to initiate discharge. By switching switches 10 and 11 to their second positions, conductive layer 5 of grid 3 is connected to earth whilst to conductive layer 4 is applied a negative potential tending to quench the discharge. In practice of course switches 11 and 12 would be electronic (e.g. transistors, thyristors etc) and, in a circuit protection arrangement, would be controlled by suitable sensors.

We claim:

1. A thyratron including at least one apertured control grid disposed between an anode and a cathode, with said apertured control grid being divided transversely into two electrically insulated parts which are separated by a layer of insulating material and which have a spacing one from the other in the region of an aperture through said two parts which is less than the Debye length of that region, and with said aperture or apertures of each said part of said grid being so dimensioned that no point within said aperture or apertures is further from one or the other of said two parts than the aforementioned Debye length.

2. A thyratron as claimed in claim 1 wherein said two parts extend parallel to one another at least throughout the region of discharge.

3. A thyratron as claimed in claim 1 wherein said insulating material is mica.

4. A thyratron as claimed in claim 1 wherein said insulating material is ceramic.

5. A thyratron including at least one apertured control grid disposed between an anode and a cathode, with said apertured control grid being divided transversely into two electrically conductive parts which are electrically insulated and separated from each other by a layer of insulating material and which are spaced from one another in the region of an aperture through said two parts and said layer of insulating material by a distance less than the Debye length of said region; and wherein: at least one of said two parts includes at least one electrically conductive grating to define the exits of the aperture or apertures on a respective side of said grid; and said aperture or apertures and said electrically conductive gratings are so dimensioned that no point within an aperture is further from one or the other of said two parts than the aforementioned Debye length.

6. A thyratron as claimed in claim 5 wherein said gratings are conductive wire meshes.

7. A thyratron as claimed in claim 6 wherein each of said parts includes a continuous conductive wire mesh extending over its surface to define the exits of said aperture or apertures.

8. A thyratron as defined in claim 5 wherein both of said two parts includes said at least one electrically conductive grating, with the electrically conductive gratings of the respective said two parts being on the respective opposite sides of said grid.

9. A thyratron as claimed in claim 1 connected in a circuit wherein means are provided at one time to connect said two parts together and apply positive potential to both in order to initiate discharge and at another time to apply negative potential between said two parts in order to effect quenching.

10. In a thyratron including at least one apertured control grid disposed between an anode and a cathode; the improvement wherein: said at least one control grid is divided transversely into two electrically insulated electrically conductive parts which have a spacing from each other in the region of each aperture through said two parts which is less than the Debye length of each said region; each of said two parts includes a respective electrically conductive apertured layer having an electrically conductive grating on one surface covering each said aperture to define its exit; said electrically conductive apertured layers are disposed on the opposite surfaces of an apertured insulating layer with said gratings being on the opposite sides of said grid; and the portions of said two parts, including said gratings, defining each said aperture are configured and dimensioned so that no point within each said aperture is further from one or the other of said two parts than said aforementioned Debye length.

11. A thyratron as defined in claim 10 wherein said gratings are conductive wire mesh.

12. A thyratron as defined in claim 10 further comprising switching circuit means, connected to said grid, for applying a positive potential to both of said two parts, so as to initiate discharge in said thyratron, when in a first position, and for applying a negative potential between said two parts, so as to effect quenching of a discharge, when in a second position.

* * * * *